US006206662B1

(12) United States Patent
Schwing

(10) Patent No.: US 6,206,662 B1
(45) Date of Patent: Mar. 27, 2001

(54) TWO-CYLINDER SLURRY PUMP

(75) Inventor: Friedrich Schwing, Gelsenkirchen (DE)

(73) Assignee: Schwing GmbH, Herne (DE)

( * ) Notice: Subject to any disclaimer, the term of this patent is extended or adjusted under 35 U.S.C. 154(b) by 0 days.

(21) Appl. No.: 09/445,781

(22) PCT Filed: Jun. 9, 1998

(86) PCT No.: PCT/EP98/03459

§ 371 Date: Dec. 10, 1999

§ 102(e) Date: Dec. 10, 1999

(87) PCT Pub. No.: WO98/57063

PCT Pub. Date: Dec. 17, 1998

(30) Foreign Application Priority Data

Jun. 11, 1997 (DE) ..... 197 24 504

(51) Int. Cl.[7] ..... F04B 7/00
(52) U.S. Cl. ..... 417/517
(58) Field of Search ..... 417/516, 517, 417/519, 532

(56) References Cited

U.S. PATENT DOCUMENTS

| | | | | |
|---|---|---|---|---|
| 3,682,575 | * | 8/1972 | Guddal et al. | 417/517 |
| 3,832,097 | * | 8/1974 | Schlecht | 417/516 |
| 3,929,400 | | 12/1975 | Merton et al. | 417/516 |
| 4,337,017 | * | 6/1982 | Evenson | 417/516 |
| 4,382,752 | * | 5/1983 | Schlecht | 417/516 |
| 4,431,386 | * | 2/1984 | Fehler et al. | 417/517 |
| 4,466,782 | * | 8/1984 | Hirashima et al. | 417/517 |
| 4,569,642 | * | 2/1986 | Dwyer | 417/516 |
| 5,061,158 | * | 10/1991 | Egli | 417/532 |
| 5,180,294 | * | 1/1993 | Watchorn | 417/516 |
| 5,281,113 | * | 1/1994 | Simnovec | 417/519 |
| 5,380,174 | * | 1/1995 | Schwing | 417/519 |

FOREIGN PATENT DOCUMENTS

| | | | | |
|---|---|---|---|---|
| 58-15772A | | 1/1983 | (JP) . | |
| 8-210245 | * | 8/1996 | (JP) | F04B/15/02 |
| 9-60579 | * | 3/1997 | (JP) | F04B/15/02 |

* cited by examiner

*Primary Examiner*—Teresa Walberg
*Assistant Examiner*—Leonid Fastovsky
(74) *Attorney, Agent, or Firm*—Kinney & Lange, P.A.

(57) ABSTRACT

A two-cylinder slurry pump (1) includes: a filling tank (2) for receiving thick matter; an agitator whose shaft (11) is placed in the filling tank (2), and a pivoting sleeve valve (16) fitted in the filling tank (2) which regulates the alternating intake and delivery strokes of the delivery cylinder. This pump also has an entry branch and an exit branch (15) pivotingly connected with the delivery piping (19). In accordance with the invention, the entry openings (46, 45) of the delivery cylinders (34, 35) are positioned behind the back wall (5) of the filling tank, and the exit branch (15) is positioned between the agitator shaft (11) and the back wall (5).

7 Claims, 1 Drawing Sheet

TWO-CYLINDER SLURRY PUMP

DESCRIPTION

Figure 1:
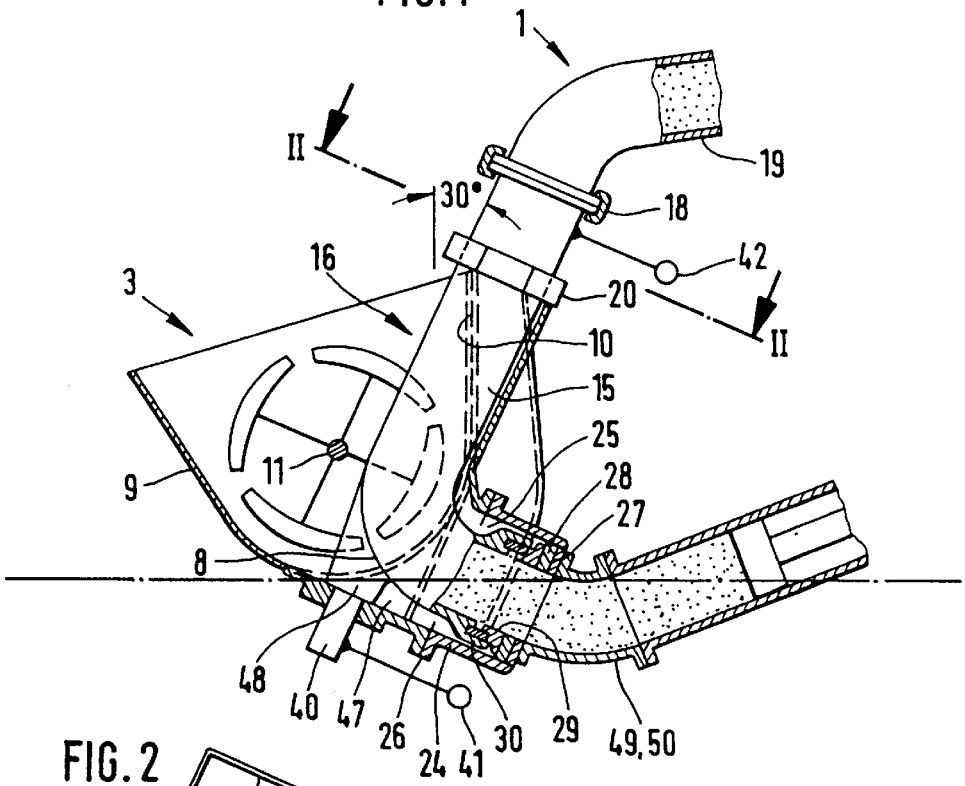

The invention concerns a two cylinder slurry pump in accordance with the heading of the claim 1.

The slurry pump as per the invention serves to convey materials or mixes thereof at a consistency between muddy and viscous which could contain fixed particles of a particular concentration. An example of a material mix of this kind is concrete in which the fixed particles are grains of sand or gravel. Such pumps convey the slurry under pressure, by way of their alternating suction and feed cylinders, through a pressure pipe. In doing so, one of the cylinder's upstream feed hoppers serves to supply the suction feed cylinder with a sufficient amount of the slurry.

Most slurry has a tendency, especially when still, to solidify. This can be a consequence of sediment. Other separation tendencies can occur when feeding concrete which can lead to the premature solidifying of the concrete. That is why, with the slurry pump as per the invention, the feed hopper has an agitator which, on the one hand, keeps the slurry moving in the container and also feeds it to the openings of the feed cylinder so that this cannot suck in any air during the normal operation. Hence the shaft of the agitator is arranged in the feed hopper and supports the agitator tools which bring about a feed effect in the direction of the cylinder openings and have the general shape of working paddles.

A sleeve valve serves to drive the feed cylinder openings in the two cylinder slurry pump as per the invention, which forms the end of the pressure pipe but is however linked with this. The free end of the sleeve valve moves with the supply of drive energy between the two openings of the feed cylinder in the feed and suction stroke of its pistons so that the feeding cylinder presses the slurry into the inlet arm of the sleeve valve, while the opening of the other feed cylinder is cleared, which means it is in direct contact with the slurry contained within the feed cylinder and sucks it in. The slurry, which is fed under pressure in the inlet arm, ends up in the outlet arm of the sleeve valve and then flows immediately from this into the pressure pipe.

For various reasons, especially however if the two cylinder slurry pump as per the invention is mobile as a vehicle pump, the need arises to limit the height of the feed hopper. One then requires an adequate feed volume, a proportionally scaled width of the feed hopper and a funnel-shaped incline at least of its front wall, i.e. the wall which is arranged on the outside of the extension of the feed cylinder, while the rear wall forms a boundary of the feed hopper to the feed cylinders. The arrangement of the sleeve valve in the feed hopper, which is provided in the two cylinder slurry pump as per the invention, leads to an adjustable movement of the slurry in addition to the agitator, as soon as the sleeve valve starts its controlling movements.

Such two cylinder slurry pumps are already known as concrete pumps (DE-AS 23 15 857). The arrangement of the paddle to the end of the agitator shaft is right next to the side wall of the feed hopper. The openings of the cylinder are located between the dividing circles which are made by the externally arranged paddles during the rotation of the agitator shaft. The inlet arm of the agitator is arranged in the feed hopper in front of the cylinder openings. With a two cylinder slurry pump of this construction the paddle can not immediately feed the slurry to the cylinder openings in order to rule out the intake of air in the feed cylinder during the suction cycle because the backwards and forwards moving inlet arm of the agitator in front of the cylinder openings takes up the middle area between the two paddles on the agitator shaft. That is why the desired dispersing effect of the paddles in the middle area of the feed hopper in front the cylinder opening does not take place. It can therefore occur during operation that the slurry thickens in this middle area and, with concrete for example, a bridge can form which obstructs the suction of the cement in the cylinder or can even prevent it. In doing so, the feeding performance, especially when pumping concrete, is considerably reduced at the least.

The invention works differently. Its fundamental idea is described in claim 1. Further characteristics of the invention are the subject matter of the subclaims.

In accordance with the invention, the openings of the feed cylinder have been positioned out of the feed hopper and towards the back. In this way the sleeve valve is able to move towards the back. As per the invention, this takes place to such an extent that the outlet arm of the sleeve valve can be arranged behind the agitator shaft on the rear wall.

With this functioning arrangement of the agitator shaft, e.g. in the centre of the feed hopper, the invention enables the paddle trim of the shaft to be driven up to around the length of the feed hopper. This results in a breaking up of the slurry directly in front of the cylinder openings whilst avoiding the bridge formation and also a stirring effect across the entire width of the feed hopper.

In accordance with a preferred embodiment of the invention, which is the subject matter of the claim 2, the sleeve valve has an L-shape which means that the inlet and outlet arm unit realises a 90° pipe bend. As the inlet arm is not limited in its length, one can, with such a shaped sleeve valve, recess the openings of the feed cylinder sufficiently enough and arrange the outlet arm of the sleeve valve between the agitator and the rear wall. In doing so, the mounts of the sleeve valve are arranged is such a way that they have a comparatively short contact travel.

A further development of this embodiment, in accordance with claim 3, is especially the L-shape of the sleeve valve, as described above, which enables the sleeve valve to tip backwards so that the axle centre of the outlet arm is tilted vertically in the direction towards the rear wall of the feed hopper, whereby the angle of inclination is an advantageous 30°. This way the cylinder openings lie deeper than the floor of the feed hopper. In doing so it is possible to keep the residue concrete in the feed hopper low after the slurry has been fed, as the agitator feeds the concrete to the middle of the feed hopper and as a result the inlet arm of the sleeve valve tilts downwards. The advantage of such a two cylinder slurry pump lies also in the fact that after the shut-down it is possible to feed no longer feedable slurry amounts, irrespective of the feed volume of the feed hopper. Therefore, when one realises the invention, one can easily increase the level of the feed material to such an extent by way of an adequate enlargement of the feed hopper, so that no suction craters can form, which can arise from the air in the feed cylinder, when accepting the slurry in the feed hopper, even at a high suction speed. Loss of slurry and disposal difficulties when clearing up the no longer feedable slurry residue from the feed hopper is therefore much decreased.

With the embodiment of the invention described up until now one mainly realises also the characteristics of claim 4, whereupon among other things the pivot bearing of the sleeve valve, which enables its control movements, is arranged on the outside of the rear wall of the feed hopper.

This way it is possible, in contrast to the latest developments in technology, to make the upper opening of the feed hopper totally free and, with the given dimensions of the feed hopper, it is possible to reduce the limitation of the filler opening through the sleeve valve to a minimum and with L-shaped sleeve valves this mainly takes place by means of the outlet arm.

With the characteristics of claim 5 the cylinder openings are established in an attached channel-shaped housing which is a closed unit apart from an opening in the feed hopper. The channel shape encloses the inlet arm of the sleeve valve and ensures that the slurry displacement caused by the swinging of the inlet arm of the sleeve point remains low. This is desirable because the tail wave occurring during the swinging of the sleeve valve to the back of the inlet arm does no longer cause a hollow space therefore improving the filling of the suction cylinder. In addition, the drive forces of the sleeve point are decreased which is also of a considerable advantage.

Figure 2:
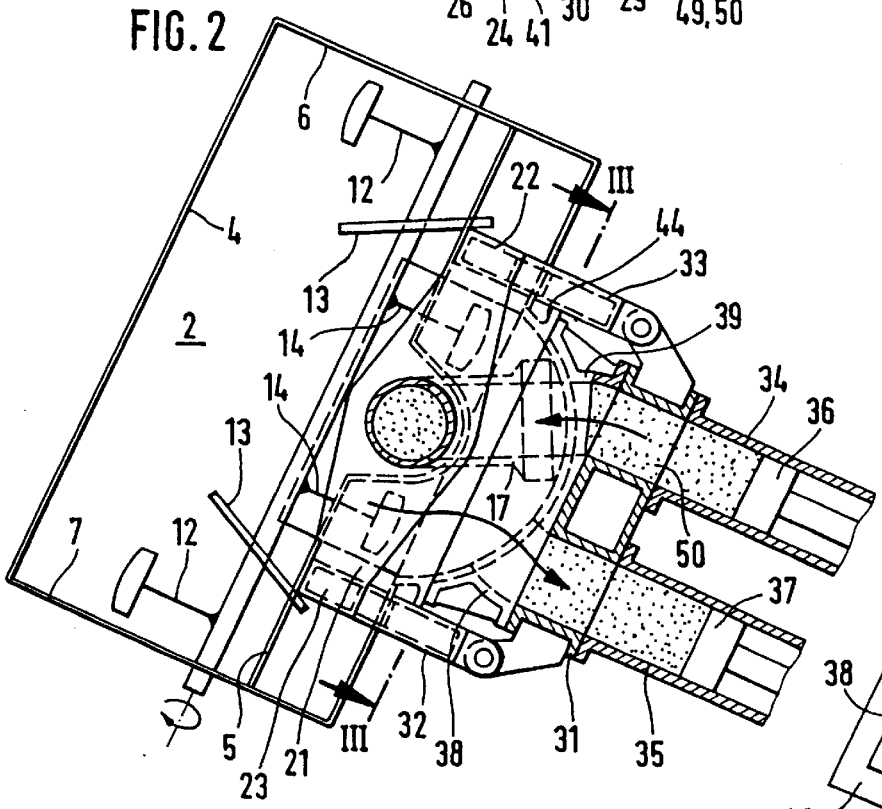
Figure 3:
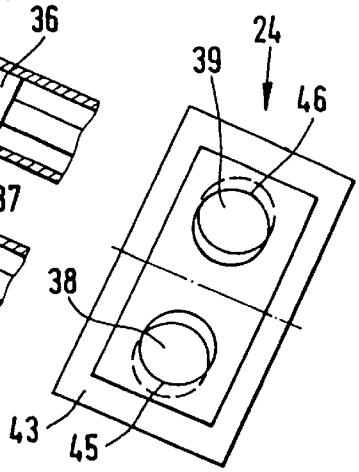

The details, further characteristics and other advantages of the invention can be seen in the following description of an example using the figures in the illustrations. It shows FIG. 1 a sectional partial view of a concrete pump in accordance with the invention, FIG. 2 a similar sectional top view of the subject matter of FIG. 1, with a sectional cut lengthways along the line II—II of the FIG. 1 and FIG. 3 a partial view with a sectional cut lengthways along the line III—III of FIG. 2.

The slurry pump, which is generally referred to as 1, in accordance with the execution example shows a feed hopper 2 in which the concrete, for example, to be fed from the mixer is fed across a slide. The feed hopper has a rectangular opening 3, the parallel long sides of which form a front wall 4 and a rear wall 5. The plans of the side walls 6 and 7 illustrate a lower bend 8 and a divergent arm 9 and 10. Thus resulting in an upper open trough shape of the feed hopper 2.

An agitator shaft 11 pushes through the approx. centre of the feed hopper 2. This is equipped with the agitator tools which are mounted to the shaft and set against one another as well as arranged at intervals from one another in the longitudinal direction of the shaft. The agitator tools 12 to 14 are arranged symmetrically to the longitudinal surfaces of the feed hopper 3 and extend, with ascending ordinal number, up to the outlet arm 15 of a sleeve valve with is generally identified referred to as 16, the other arm of which serves as an inlet arm for the concrete and has an angle of approximately 90° to the outlet arm 15. This results in an L-shaped arrangement of the sleeve valve, which swings in the sleeve pivot joint 18 around the shaft of the rising outlet arm 15, whereby the sleeve pivot joint 18 is connected to the end of a pressure pipe 19. A pivot bearing 20 supports the sleeve valve 16 on a crossbeam 21 which is mounted at both ends at 22 and 23 by rising supports.

A channel-shaped housing 24 is flanged with its internal opening 25 at 26 to the floor of the hopper. The housing 24 has a curve-shaped rear wall 27, the curve of which corresponds to the swinging motion of the inlet arm. On the inside of the curve-shaped wall 27 sits a cartridge plate 28 while a cut ring 29 forms the end (which can wear and tear) of the inlet arm 17 and is pressed with a rubber-elastic seal 30 against the cartridge plate 28.

A connecting housing 31, which is linked on both sides to the rising supports 32 and 33, forms the connection to the feed cylinders 34 and 35.

The cartridge plate encloses both openings 45 and 46, through which the feed cylinder 34, 35 suck and feed concrete through the sleeve valve 16 into the pressure pipe 19. These openings form the respective internal ends of two tubular supports 38 and 39 which are curved outwards from the curve-shaped rear wall 27 of the channel housing 24, in order to bridge the construction-determined lateral distance of the two feed cylinders 34 and 35 with their pistons 36 and 37.

The L-shaped unit from the inlet arm 17 and the outlet arm 15 as well as the 90° inclination of the sleeve valve 16 is inclined by around 30° backwards in the direction of the rear wall 5 of the feed hopper 2 and the feed cylinders 34 and 35 lying behind it. Due to this, the inlet arm 17 and the channel housing 24, which encloses it protrudes downwards. Below the opening of the channel housing in the feed hopper 2 is a tip chute 47 on which the concrete is transported in front of the feed cylinder openings 45 and 46.

The sleeve valve 16 swings in the cycle of the counter-rotating pistons 36 and 37 in front of the feed cylinder openings of the respective suction pistons 37 around the longitudinal axis of the outlet arm 15 in the bearing 20 and the sleeve pivot link 18 of the pressure pipe 19. The sleeve valve is additionally supported with pins 48 to its lower drive shaft 40 on the floor of the tip chute 47. A lower drive 41 or a higher drive 42 transmits the kinetic energy for the sleeve valve to the shaft 40 or the upper end of the outlet arm 15 between the bearing 20 and the sleeve pivot joint 18.

Depending on the construction, the feed cylinders 34, 35 are inclined vertically upwards. The connection between the inclination of the tip chute 47 and the channel housing 24 with the feed cylinder ends produces the connecting housing 31 which has the pipe bends 49, 50 and is connected with 43 and 44 to the channel housing 24.

During operation, the concrete is shovelled with the aid of angled driving paddles 12 to 14 of the agitator from both sides of the feed hopper 2 to the middle and reaches the tip chute 47 in front of the cylinder openings 45 and 46 of the respective suction feed cylinders 34 and 35. This provides a hydrostatic concrete pressure in front of the respective suction openings which exceed the height of the floor 8 of the feed hopper 2, whereby the agitator ensures that sufficient concrete is always available in order to avoid the formation of suction craters in front of the openings 45 and 46. At the end of the feed operation, the feed hopper will be practically empty as no residue concrete remains in the feed hopper 2 by way of the effects of the paddles.

REFERENCE SIGN LIST

1 Slurry pump
2 Feed hopper
3 Opening
4 Front wall
5 Rear wall
6 Side wall
7 Side wall
8 Floor
9 Arm
10 Arm
11 Agitator shaft
12 Agitator tools
13 Agitator tools
14 Agitator tools
15 Outlet arm
16 Sleeve valve
17 Inlet arm

18 Sleeve pivot joint
19 Pressure pipe
20 Pivot bearing
21 Crossbeam
22 Support
23 Support
24 Channel housing
25 Opening
26 Flange
27 Curve-shaped rear wall
28 Cartridge plate
29 Cut ring
30 Seal
31 Connecting housing
32 Rising support
33 Rising support
34 Feed cylinder
35 Feed cylinder
36 Piston
37 Piston
38 Tubular support
39 Tubular support
40 Drive shaft
41 Swing drive
42 Swing drive
43 Flange
44 Flange
45 Feed cylinder opening
46 Feed cylinder opening
47 Tip chute
48 Pins
49 Pipe bend
50 Pipe bend

What is claimed is:

1. Two cylinder slurry pump with a feed hopper for the admission of slurry, an agitator, the shaft of which is inserted in the feed hopper and a swivel sleeve valve, which is arranged in the feed hopper, serves to control the alternating suction and feed cycle of the feed cylinder and in front of the openings of the feed cylinder there is a swivel inlet arm as well as an outlet arm which has a revolving connection to the pressure pipe, whereby the openings of the feed cylinder behind the rear wall of the feed hopper and the outlet arm between the agitator shaft and the rear wall are arranged on this wherein the inlet and outlet arm of the sleeve valve have a right-angled L-shaped layout, identified by the axle centre of the outlet arm sloping vertically towards the rear wall of the feed hopper in such a way that the inlet arm of the L-shaped unit points downwards.

2. Two cylinder slurry pump in accordance with claim 1, thereby identified by the shaft of the outlet arm sloping towards the rear wall of the feed hopper with a ca. 30° vertical angle.

3. Two cylinder slurry pump in accordance with claim 1, thereby identified by the top of the sleeve valve on the outside of the rear wall of the feed hopper being mounted to the base of a tip chute and likewise at the bottom in the extension of its outlet arm, which serves as a connection to the feed cylinder openings.

4. Two cylinder slurry pump in accordance with claim 1, thereby identified by a channel housing which is connected to the feed hopper which is a closed unit apart from an opening in the feed hopper and encloses at least the front end of the inlet arm of the sleeve valve.

5. Two cylinder slurry pump in accordance with claim 1, identified by a channel housing having tubular supports which are formed and arranged in such a way that the lateral distance of the feed cylinder openings is less than that of the feed cylinder.

6. Two cylinder slurry pump in accordance with claim 1, identified by a connection housing being provided between tubular supports of a channel housing and of the feed cylinders which form a transition curve from the downwards angle of the tip chute and/or of the channel housing in the direction of the feed cylinder.

7. Two cylinder slurry pump in accordance with claim 1, identified by the pin of the lower pivot bearing or the outlet arm of the sleeve valve between the pivot joint and the pressure pipe serve as the drive shaft of the sleeve valve.

* * * * *